US006058924A

United States Patent [19]

Pool, III et al.

[11] Patent Number: 6,058,924

[45] Date of Patent: May 9, 2000

[54] VENTED RECYCLING OVEN WITH SEPARATE CATALYTIC CONVERTER

[75] Inventors: James K. Pool, III, Richardson, Tex.; David H. McFadden, Lexington, Mass.; Earl R. Winkelmann, Garland, Tex.

[73] Assignee: TurboChef Technologies, Inc., Dallas, Tex.

[21] Appl. No.: 09/430,099

[22] Filed: Oct. 29, 1999

Related U.S. Application Data

[63] Continuation-in-part of application No. 09/304,921, May 4, 1999, which is a continuation of application No. 08/863,671, May 27, 1997, Pat. No. 5,927,265.

[51] Int. Cl.[7] ..... F24C 15/32

[52] U.S. Cl. ..... 126/21 A; 219/400

[58] Field of Search ..... 126/21 A; 219/400

[56] References Cited

U.S. PATENT DOCUMENTS

| | | | |
|---|---|---|---|
| 2,658,742 | 11/1953 | Suter et al. | 219/400 |
| 2,795,054 | 6/1957 | Bower | 219/400 |
| 2,862,095 | 11/1958 | Scofield | 126/21 A |
| 3,364,912 | 1/1968 | Dills et al. | 219/400 |
| 3,785,778 | 1/1974 | Burstein | 219/400 |
| 3,828,760 | 8/1974 | Furber et al. . | |
| 4,138,220 | 2/1979 | Davies et al. . | |
| 4,437,451 | 3/1984 | Wysong . | |
| 4,460,332 | 7/1984 | Lawler et al. . | |
| 4,492,569 | 1/1985 | Vestergaard . | |
| 4,494,525 | 1/1985 | Albertsen . | |
| 4,648,378 | 3/1987 | Nishikawa . | |
| 5,166,487 | 11/1992 | Hurley et al. . | |

FOREIGN PATENT DOCUMENTS

| | | | |
|---|---|---|---|
| 56-44536 | 9/1979 | Japan | 126/21 A |

*Primary Examiner*—Carroll Dority
*Attorney, Agent, or Firm*—Amster, Rothstein & Ebenstein

[57] ABSTRACT

A recycling cooking oven for cooking food at least in part by hot air flow and providing a substantially closed but vented environment includes a cooking chamber for receiving a stream of hot air from an upstream thermal plenum via a plurality of openings in the cooking chamber, the cooking chamber cooking food therein at least partially with hot air from the plurality of openings and the cooking of such foods adding oxidizable components to the hot air. A blower circulates the stream of hot air in substantially a continuous travel path including the thermal plenum, the plurality of openings and the cooking chamber. A main catalytic converter is disposed in the continuous travel path for flamelessly oxidizing the oxidizable components leaving the cooking chamber. A vent communicating with ambient atmosphere and the main catalytic converter diverts an auxiliary vent stream of hot air from the main catalytic converter into the vent; and an auxiliary catalytic converter is disposed in the vent, downstream of the main catalytic converter, for flamelessly oxidizing oxidizable components in the hot air of the auxiliary vent stream passing through the vent, thereby to further remove oxidizable components from the hot air of the auxiliary vent stream and so release a relatively clean auxiliary vent stream of hot air from the vent into the ambient atmosphere.

14 Claims, 4 Drawing Sheets

VENTED RECYCLING OVEN WITH SEPARATE CATALYTIC CONVERTER

CROSS REFERENCE TO RELATED APPLICATIONS

This is a continuation-in-part of U.S. patent application Ser. No. 09/304,921, filed May 4, 1999, itself a continuation of application Ser. No. 08/863,671, filed May 27, 1997, now U.S. Pat. No. 5,927,265.

BACKGROUND OF THE INVENTION

The present invention relates to a recycling cooking oven for cooking food at least in part by hot air flow (e.g. hot air impingement), and more particularly to a vented recycling cooking oven providing a substantially or essentially closed but vented cooking environment.

U.S. Pat. No. 5,927,265 discloses a recycling cooking oven for cooking food at least in part by hot air flow and providing a substantially closed environment. The oven comprises a cooking chamber for receiving a stream of hot air from a thermal plenum via a plurality of openings in the cooking chamber, the cooking chamber cooking food therein at least partially with hot air from the plurality of openings and the cooking of such foods adding oxidizable components to the hot air. Means forming a thermal plenum are located upstream of the cooking chamber and include heating means for supplying hot air into the cooking chamber via the plurality of openings. Means are provided for causing the stream of hot air to circulate in a substantially continuous travel path including the thermal plenum, the plurality of openings, and the cooking chamber. A main catalytic converter is disposed in the continuous travel path of the stream of hot air for flamelessly oxidizing oxidizable components in the hot air of the stream leaving the cooking chamber, thereby both to remove them from the hot air of the stream and to release at least some additional heat energy into the hot air of the stream.

Preferably the thermal plenum maintains the reservoir of hot air at a temperature such that the main catalytic converter has an inlet temperature allowing catalytic activity (destruction of oxidizable components) to occur. The oxidizable components may include grease, fats, oils and like hydrocarbons produced by cooking food in the cooking chamber and are preferably oxidizable essentially to carbon dioxide and water.

However, as a practical matter, it is frequently desirable, if not absolutely necessary, to control the exchange of air between the oven cavity interior and ambient in a substantially recycling cooking oven via a vent. The vent enables the planned escape of hot air from the oven. Various factors render such a vent desirable and necessary. First, the natural expansion of the air within the oven as it becomes heated will increase the pressure of the air being circulated. An increase in the pressure of the hot air being circulated may be undesirable since it could result in leakage of the air out of the oven into the ambient atmosphere, or a blast of hot air being directed at a user when the user opens the oven door. Thus, it is preferable to allow the volume of the gas to change (via a vent) so as to maintain a constant gas pressure. Second, during cooking a portion of the moisture evolved from the food product must be vented in order to provide acceptable food surface conditions. Third, if the oven is to have a self-cleaning feature, the various oxidizable components removed from the walls of the cooking chamber must be removable from the oven interior via a vent. Fourth, there exists a certain amount of leakage from ambient air into the oven cavity, which should be compensated for via means of a vent.

For the above and related reasons well recognized by those skilled in the oven art, it is desirable to provide a vent communicating with the ambient atmosphere and the oven interior for diverting an auxiliary vent stream of hot air from the interior of the essentially recycling oven into the vent means.

Use of a vent for communication between the cooking chamber and associated plenums and ducts of the oven and the ambient atmosphere presents new problems if the oven is to comply with various indoor air quality standards and consumer expectations for clean indoor air such as the cleanliness of the auxiliary vent stream emitted into the ambient atmosphere, via the vent means, from the oven interior.

German Patent Application No. 26 40 684, filed Sep. 7, 1976, discloses a recycling cooking oven providing a substantially closed but vented environment. The hot air stream leaving the cooking chamber is bifurcated into a recycling stream which passes through a first or recycling catalytic converter before it is returned to the cooking chamber and a vent stream which passes through a second or vent catalytic converter disposed in the vent. Neither the recycling stream nor the vent stream passes through both catalytic converters; each stream passes only through a respective one catalytic converter. As a result, if the second or vent catalytic converter, is to provide a lower level of oxidizable components than is found in the recycling stream after it passes through the first or recycling catalytic converter, the second or vent catalytic converter must be configured and dimensioned, initially, to reduce the level of oxidizable components in the vent stream to that of the recycling stream after it passes through the first catalytic converter, and, then, it must reduce the level of oxidizable components further to what is deemed an acceptable discharge level. Depending upon the fraction of the total hot air stream being sent through the second or vent catalytic converter, this may require a second or vent catalytic converter of greater dimensions and/or more expensive highly active catalytic material than the first or recycling catalytic converter, thereby placing the oven at an economic disadvantage.

This follows from the fact that in a recycling oven, as disclosed in the aforementioned German application, the first or recycling catalytic converter acts on the entire stream of hot air leaving the cooking chamber (excluding the vent stream). This entire stream will pass through the first or recycling catalytic converter several times. Accordingly, it is only necessary for the first or recycling catalytic converter to remove a fraction (say, 20% by volume) of the oxidizable components on each pass (five passes presumably being sufficient to remove all of the oxidizable components). Therefore the first or recycling catalytic converter may be formed of less expensive and less catalytically active materials and/or be of smaller dimensions than would be the case if it were required that it substantially oxidize all of the oxidizable components present in the recycling stream on each pass. By way of contrast, the second or vent catalytic converter has only one pass in which to remove the oxidizable components in the vent stream to an acceptable discharge level. Accordingly, the second or vent catalytic converter of the above-identified German Application must be made of more efficient catalytically active (hence more expensive) materials and/or of greater dimensions than the first or recycling catalytic converter.

Accordingly, it is an object of the present invention to provide a recycling cooking oven affording a substantially closed but vented environment.

Another object is to provide such an oven including in the vent means an auxiliary catalytic converter, downstream of the main catalytic converter, for further reducing the level of oxidizable components in the vent stream.

A further object is to provide such an oven wherein the vent catalytic converter (due to changes in dimensions and/or catalytic material) is more economical than the main catalytic converter.

Yet another object is to provide such an oven that is self cleaning.

It is also an object of the present invention to provide such an oven which is simple and economical to manufacture, use and maintain.

SUMMARY OF THE INVENTION

The above and related objects of the present invention are obtained in a recycling cooking oven for cooking food at least in part by hot air flow (e.g., hot air impingement) and providing a substantially closed but vented cooking environment. The oven has a cooking chamber for receiving a stream of hot air from a thermal plenum via a plurality of openings in the cooking chamber, the cooking chamber cooking food therein at least partially with hot air from the plurality of openings and the cooking of such foods adding oxidizable components to the hot air. The oven also has means forming a thermal plenum located upstream of the cooking chamber and including heating means for supplying hot air into the cooking chamber via the plurality of openings, and means for causing the stream of hot air to circulate in substantially a continuous travel path including the thermal plenum, the plurality of openings and the cooking chamber. A main catalytic converter is disposed in the continuous travel path of the stream of hot air for flamelessly oxidizing oxidizable components in the hot air of the stream leaving the cooking chamber, thereby both to remove them form the hot air of the stream and to release at least some additional heat energy into the hot air of the stream. Vent means communicate with ambient atmosphere and the main catalytic converter for diverting an auxiliary vent stream of hot air from the main catalytic converter into the vent means. An auxiliary catalytic converter is disposed in the vent means, downstream of the main catalytic converter, for flamelessly oxidizing oxidizable components in the hot air of the auxiliary vent stream and so release a relatively clean auxiliary vent stream of hot air from the vent means into the ambient atmosphere.

In a preferred environment, the thermal plenum maintains the reservoir of hot air at least 325°, and preferably between 325° F. and 570° F. The main catalytic converter has an inlet temperature of at least 325° F. The auxiliary catalytic converter has an inlet temperature of at least 325° F. and is capable of oxidizing hydrocarbons at temperatures of at least 325° F. The oxidizable components include grease, fats, oils and like hydrocarbons produced by cooking food in the cooking chamber, and the oxidizable components are oxidizable essentially to carbon dioxide and water. It is desirable to have substantial catalytic activity occurring in the 475° F. to 550° F. temperature range associated with broiling and grilling grease laden food products.

The vent means may communicate substantially directly with the main catalytic converter or only via the thermal plenum.

Preferably, the plurality of openings is in a top of the cooking chamber, and the heating means supplies hot air downwardly into the cooking chamber via the plurality of openings. In general, the vent catalyst must be more effective than the main catalytic converter, given that it must control the outlet vent air emissions to very low levels.

A single pass of an auxiliary vent stream of hot air through the auxiliary catalytic converter preferably lowers the level of the oxidizable components in the hot air more than would a single pass of the same stream of hot air through the main catalytic converter.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
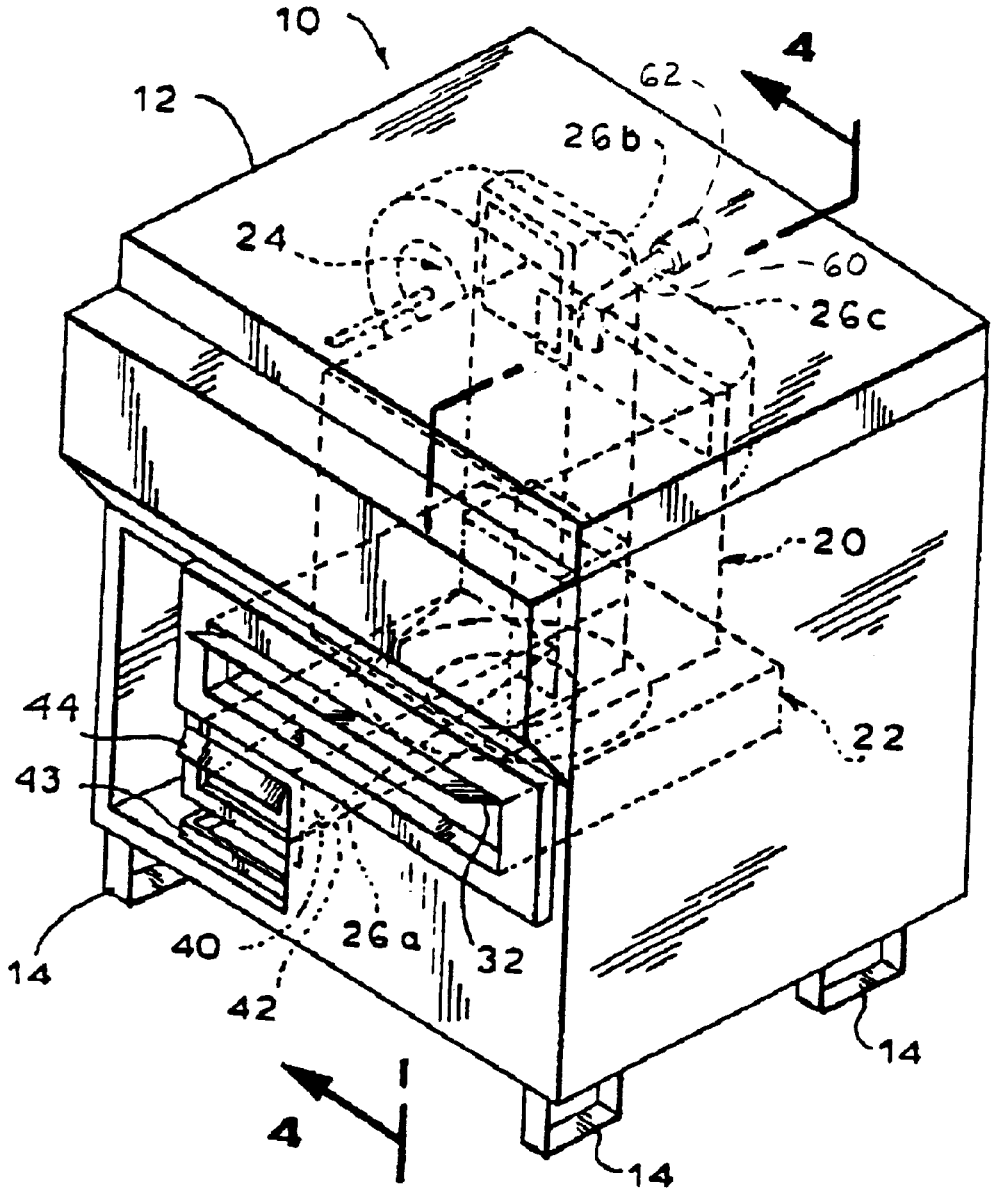
FIG. 1 is an isometric view of an oven according to the present invention.
Figure 2:
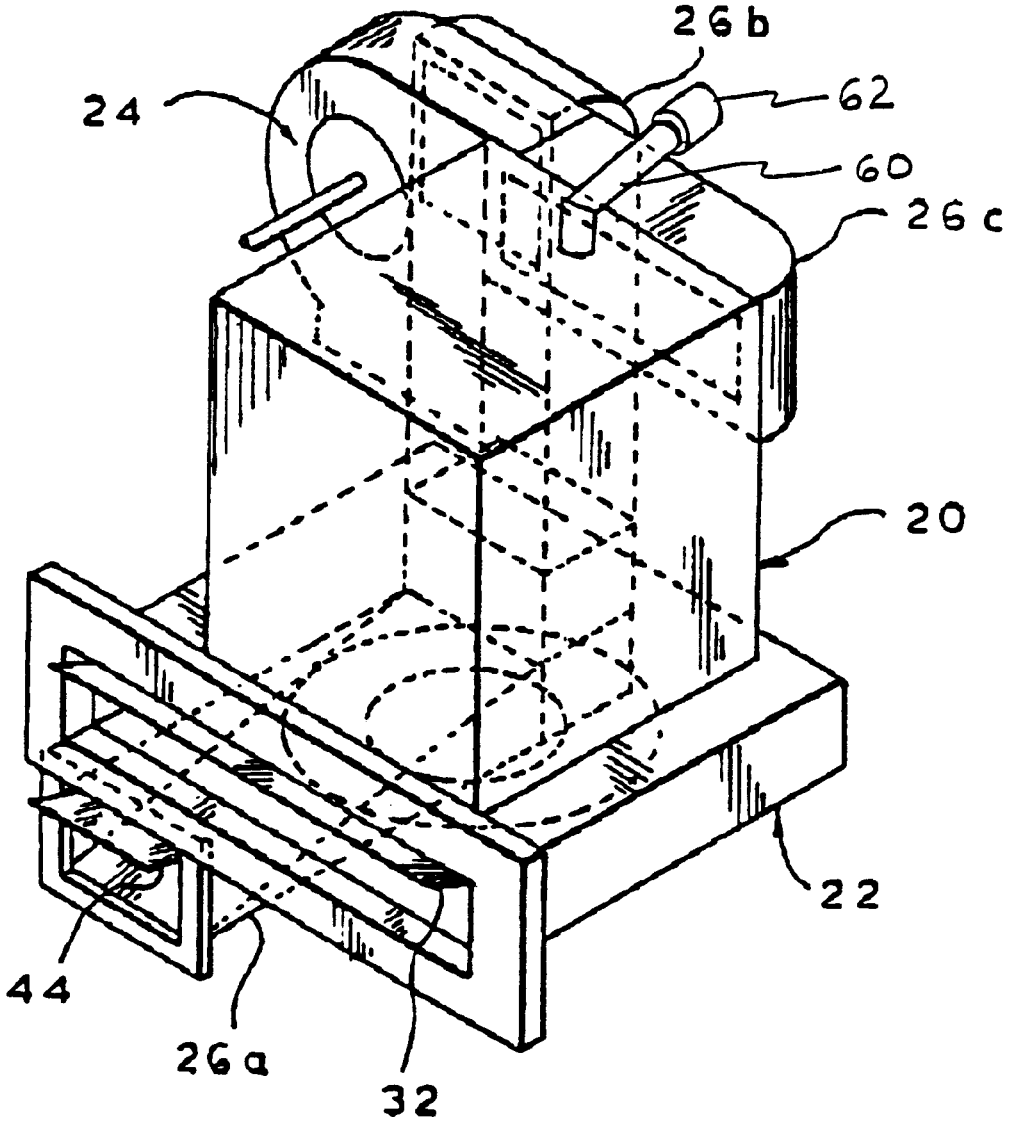
FIG. 2 is an isometric view similar to FIG. 1, but without the oven housing.
Figure 3:
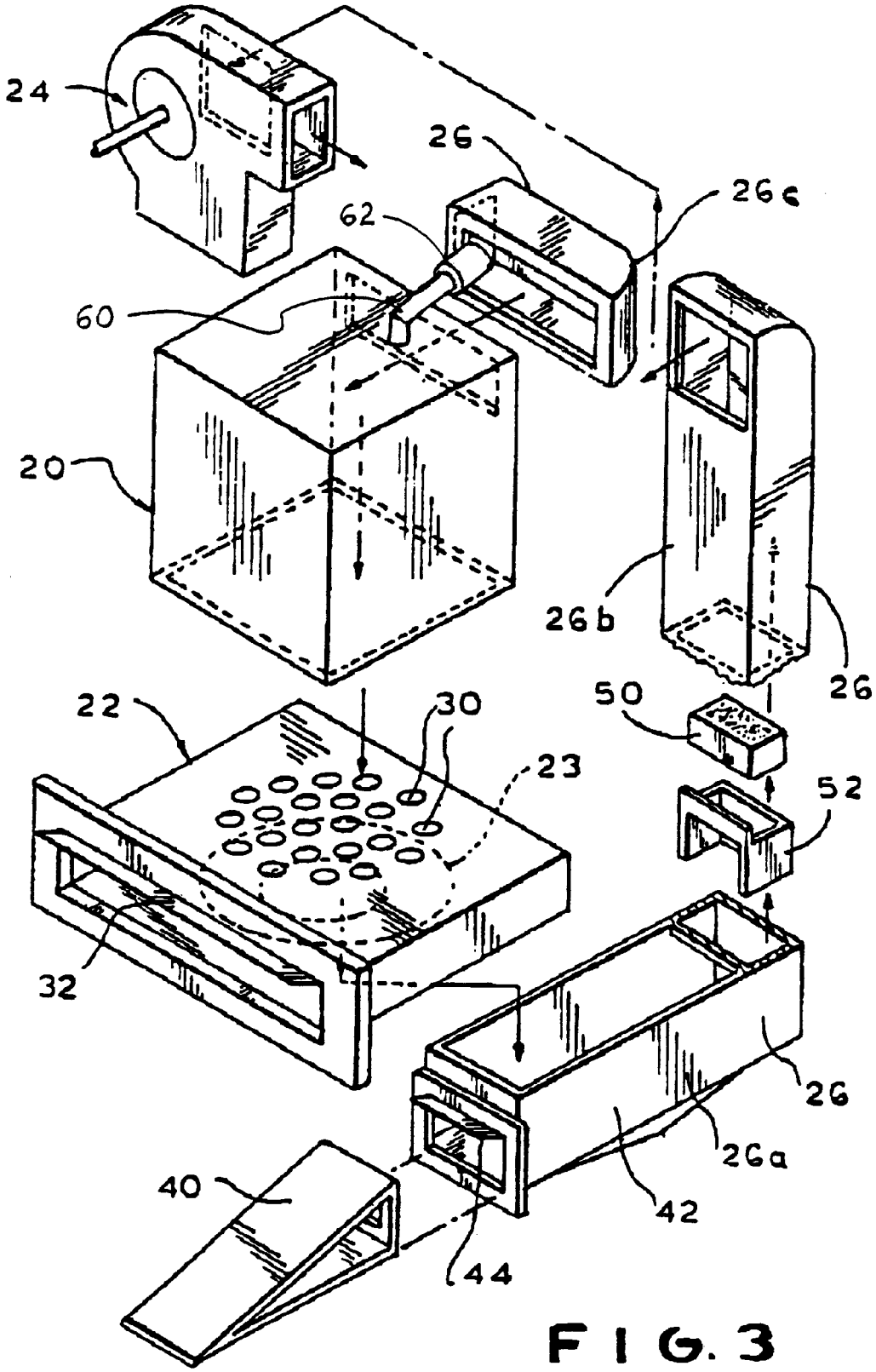
FIG. 3 is an exploded schematic view of the oven without the oven housing.

Referring now to the drawing and in particular to FIG. 1 thereof, therein illustrated is substantially a recycling oven according to the present invention, generally designated by the reference numeral 10, which provides a substantially closed but vented environment. The functioning parts of the oven 10 are disposed in a housing 12 supported by feet 14. The functioning parts are illustrated in FIG. 2 without the housing and are schematically illustrated in the exploded view of FIG. 3, wherein the arrows represent the travel path of the stream of hot air.

In its conventional aspects, the oven 10 comprises a thermal plenum generally designated 20, a cooking chamber generally designated 22, and means 24, 26 for causing a stream of hot air to circulate in a substantially continuous travel path (illustrated by the arrows of FIG. 3) including the thermal plenum 20 and cooking chamber 22. More particularly, the circulating means 24, 26 includes a motor-driven blower 24 (the motor not being shown) and ducting 26.

More particularly, in the embodiment illustrated the thermal plenum 20 is configured and dimensioned to maintain a reservoir of hot air therein of adequate volume such that, once the oven has been warmed-up, the plenum 20 has sufficient hot air therein to immediately commence the process of cooking whatever foods are placed in the cooking chamber 22. To this end, the thermal plenum 20 contains heating means (not shown) such as electrical heating elements (either with or without a phase-change reservoir of heat). A temperature sensor (not shown) is preferably disposed within the thermal plenum 20 to regulate the heating means and ensure that the reservoir of hot air is maintained at an appropriate temperature. The thermal plenum 20 preferably maintains the reservoir of hot air at least 325° F. (and optimally at 325°–570° F.) for reasons which will become apparent hereinafter. It will be appreciated, however, that in another embodiment heating of the plenum air may be performed on the fly (that is, without a reservoir of hot air being maintained in the plenum).

The plenum 20 supplies a stream of hot air into the cooking chamber 22 via a series of perforations, manifolds, or the like, as necessary to provide hot air flow (e.g., hot air impingement) cooking of the food within the cooking chamber 22, and receives a stream of hot air from the cooking chamber 22 via the ducting 26, the blower 24, etc.

The cooking chamber 22, as earlier noted, supplies a stream of hot air into the thermal plenum 20 via the ducting 26, blower 24 and the like, and receives a stream of hot air from the thermal plenum 20 via a series of perforations, manifolds 30 or the like. The cooking chamber cooks the foods therein (not shown) at least partially with the stream of hot air and, in turn, the foods undergoing the cooking process add oxidizable components to the hot air of the stream. Depending upon the particular foods being cooked in the cooking chamber, the oxidizable components released from or formed by the foods include grease, fats, oils and other hydrocarbons produced by or resulting from the cooking of the foods in the cooking chamber 22. The cooking chamber 22 includes an oven housing door 32 which may be opened for the placement of foods within the cooking chamber 22 and the removal of cooked foods therefrom.

A motor-driven blower 24, preferably of variable speed, causes the stream of hot air to circulate in substantially a continuous travel path including the thermal plenum 20, the cooking chamber 22 and the various elements of ducting 26.

The ducting 26 includes a filter mechanism 26*a,* a vertical duct 26*b* leading from the filter mechanism 26*a* to the blower 24, and a horizontal duct 26*c* which receives the hot air from the blower 24 and introduces it into the thermal plenum 20. Just above the filter mechanism 26*a* the bottom surface of the cooking chamber 22 has a large circular void. A donut-shaped catch basket 23 is disposed in the void at the bottom of the cooking chamber 22 and captures any large particles of food which break off during the cooking operation, with gravity holding the large particles of food in the catch basket for easy removal during the daily cleaning operation. The cooking disc (not shown), which supports the food product during cooking, is mounted on the oven housing door 32 for movement therewith and sits atop this catch basket 23 during cooking.

The filter mechanism 26*a* includes an inclined metal filter screen 40 which is disposed in a filter housing 42. All of the hot air which has been used in the cooking operation passes through the screen 40. This screen 40 mechanically removes airborne particles, including larger particles of grease, and deposits these in a catch pan 43 located therebelow. The catch pan 43 is preferably located just below the interface of the filter housing 42 and a filter door 44 enabling access to the filter housing 42, thereby to capture any seepage from the interface, especially when the door 44 is open. When the housing door 44 is opened, it enables passage of the filter housing 42 (including the screen 40) through the doorway. Both the filter screen 40 and the catch pan 43 are easily removed from the oven 10 during the daily cleaning operation.

The interior oven surface (below the filter housing 42) is preferably inclined towards the center and provided with a waste tube 46 which transfers any liquid waste accumulating in the center towards a removable pan 48 disposed outside the housing 12 (e.g., slidably attached to the bottom exterior surface of the oven).

U.S. Pat. Nos. 5,254,823; 5,254,823; and 5,434,390 are hereby incorporated by reference in their entirety. As recycling ovens of the type described herein are well-known to those skilled in the art—e.g., from the aforementioned three U.S. patents—it is not deemed necessary to provide additional details thereof. It will be appreciated, however, that the aforementioned conventional components of the present invention are similar to those described in conjunction with the aforementioned U.S. patents except that the sequence and relative locations of the various components have been modified somewhat.

It will be appreciated that, while the embodiment illustrated relies exclusively upon hot air flow cooking, a hybrid oven according to the present invention may rely as well on microwave cooking. Where appropriate, the center of the donut-shaped catch basket 23 may incorporate a window or aperture which permits microwave transmission therethrough.

Turning now to the novel aspects of the present invention, the oven 10 of the present invention includes a main catalytic conversion unit or converter 50 and a holder 52 therefor, both being removably disposed or adjacent in the rear of the filter housing 42. The main catalytic converter 50 is disposed in the travel path of the hot air stream downstream of the mechanical filter 40.

The holder 52 fits into the rear of filter housing 42 and supports the converter 50, preferably at least partially in vertical duct 26*b* leading to the blower 24. To periodically clean the converter 50, the mechanical filter screen 40 is removed from its housing 42, the converter 50 is pushed upwardly all the way into vertical duct 26*b,* the filter housing 42 and converter holder 52 are removed through a passageway, and then the converter 50 is pulled down and removed through the same passageway.

The oxidation catalyst 50 acts on a combustion mixture in much the same way that spark or flame ignition do, but at a lower temperature and without a flame. Thus, to obtain combustion both sufficient temperature for sustained catalytic activity ("light-off") and sufficient oxygen must be present. However, an important difference between catalytic oxidation and spark or flame ignition firing is that the former can cause total combustion of very low concentrations of combustible material, which could not sustain combustion in the absence of the catalyst or very high temperatures. The reason is that the combustion or oxidation reaction actually takes place at the surface of the catalyst.

When combustible substances made from carbon, hydrogen, and oxygen react completely with oxygen in the air, they produce carbon dioxide and water along with a predictable amount of heat. The heat released (that is, the exothermic heat of reaction) causes the gas temperature to rise within the converter. For most applications it is recommended that the air/fuel ratio be adjusted to give a maximum temperature rise between the outlet and inlet of the converter no greater than 200° F.–300° F.

For typical volatile hydrocarbons the converter inlet temperature should be at least 325° F., preferably 325° F.–570° F. The catalytic converter causes the combustion of the airborne grease from cooking to occur between 325° F. and 550° F., which includes the normal operating range of the oven. The catalyst materials typically function most effectively for this application within a temperature range of 325° F. to 550° F. (preferably 475° F. to 500° F.), which is the cooking range of broiling and grilling meats. Normal grease and odor-laden air streams emanating from cooking operations are effectively oxidized at a temperature of about 500° F.

Since the volume of air utilized by the oven is recirculated rapidly and frequently, successive and cumulative conversion allows for a continual and complete clean-up of the air stream.

Considering now the catalyst and catalyst substrate structure which is useful in the practice of the invention, it is to be understood that catalysts and substrate structures other than those specifically described and illustrated herein can be utilized without departing from the scope of the invention. Various catalysts capable of flameless oxidation of greases, oils, etc. and the fumes and odors characteristic thereof can be used, different catalysts having different operating temperature ranges and being most effective for different hydrocarbons at differing sub-ranges within the operating temperature ranges thereof.

A preferred catalytic system comprises a honey-comb substrate of refractory material which is coated with a platinum-containing catalyst. The honey-comb substrate offers a large surface area for coating by the catalyst and, thus, a large effective surface area for contact between the catalyst and the organic materials which are to be oxidized. Catalysts suitable for coating the honey-comb substrate include platinum-based catalysts such as tetramine platinum nitrate $(NH_3)_4Pt(NO_3)_2$, mixtures of chloroplatinic acid, alumina and dextrose, or a solution of tetramine platinum nitrate of the formula $(NH_3)_4$ $Pt(NO_3)_2$. Mixtures of a platinum compound with a compound of another additive metal, such as palladium, rhodium, ruthenium, iridium, etc., in various ratios, usually with the platinum compound predominating, are also useful in the practice of this invention. The catalyst material is deposited on the surfaces of the substrate, usually by dipping of the substrate into a dispersion or solution thereof and then drying or heat treating the coated substrate to fix the catalyst material on the substrate. The honey-comb substrate can be formed of Torvex, a ceramic made by the DuPont Corporation, or of similar materials manufactured by Dow Corning, Inc. or Minnesota Mining and Manufacturing, Inc., etc. Catalyst-coated granules of a silica/alumina substrate material are also useful as are other well-known refractory metal oxides. Other catalytic methods include the use of pellets, etc.

An especially preferred catalytic converter formed of a calcined alumina substrate with platinum on a stainless steel support is available under the trade name CAMET OXIDATION CONVERTER (from W.R. Grace & Co. of Hiram, Ohio 44234, now Engelhard Corporation of Iselin, N.J.). For grilling operations, the typical densities for oxidation are 100–350, preferably 140, cells/inch$^2$ and a preferred catalyst density is 30 g/ft$^3$. Another especially preferred catalytic converter is made of corrugated ferritic stainless-steel foil arranged in a design that promotes contacting with the hot air stream. The foil is coated with an aluminum oxide washcoat containing various metal oxide promoters and small amounts of an active catalyst from the platinum group—that is, platinum, palladium, or rhodium.

Poisoning of the catalytic sites due to chemical reactions with the catalyst and the masking of sites (by materials which cover but do not combine chemically with the sites) may be dealt with in the normal manner, typically using various cleaning or replacement techniques.

The basic operation of a recycling oven is efficient in its utilization of primary energy from electrical power or natural gas (air heating) supply. The addition of a relatively free secondary source of available heat (from the catalytic combustion process) makes it even more efficient. The free secondary source of energy reduces the heating demand on the heat reservoir and enables the pre-set thermal plenum temperatures to be maintained at a lower operating cost.

The destruction efficiency of the catalytic conversion process vastly reduces the amount of airborne grease—and accompanying odor—which is recirculated over food products cooked simultaneously or sequentially. This allows the operator to cook a wider variety of food products, each maintaining its distinctive flavor, with a much higher production through-put than conventional cooking methods, which require similar foods to be segregated and cooked separately. For example, according to the present invention, a delicate puff pastry can be baked in the same or a subsequent cooking sequence as a raw fish fillet. As another example, cooked pepperoni pizza has a distinctive aroma associated with the pepperoni that can linger in an oven due to the presence of grease in circulating air. This lingering aroma can be transferred to subsequently cooked food products, such as cheese pizza, which is particularly sensitive to odor absorption. Nonetheless, the destruction efficiency of the catalytic conversion process enables such foods (i.e., pepperoni pizza and cheese pizza) to be cooked sequentially.

The present invention not only minimizes heat energy costs and provides superior cooking of a variety of different food products (either simultaneously or sequentially), but it also reduces the amount of manual labor required in the daily cleaning operation. The catalytic combustion process removes a large amount of airborne grease (and converts it to heat energy) so that it is not deposited on the surfaces of the cooking chamber and the mechanical filters. Since grease is the most insidious foreign element produced in the cooking process, its removal substantially reduces the time (and cost) required for cleaning the oven by hand in the daily maintenance procedures.

Finally, because the present invention greatly reduces the amount of airborne grease which is discharged into the air in a restaurant kitchen, it eliminates the need for a kitchen exhaust ventilation system and minimizes the noticeable and often unpleasant airborne grease odor wafting to the customers, especially in "open kitchen" configurations where customer traffic comes into direct contact with the cooking area. The present invention eliminates cleaning labor associated with cleaning kitchen surfaces near an oven emitting grease laden air.

While the oven 10 described hereinabove is primarily a commercial oven (that is, an oven intended for use in commercial establishments), the principles of the present invention are equally applicable to a residential oven (that is, an oven intended for home use) as illustrated in U.S. patent application Ser. No. 09/199,902, filed Nov. 25, 1998.

To summarize, the present invention provides a recycling oven which requires the addition of only a minimum of heat energy for continued cooking operation, permits different foods to be cooked in simultaneous or consecutive cooks with only a minimum of flavor and odor transfer between the different foods. Further, the oven does not require an exhaust (to ambient) hood ventilation system and minimizes the amount of manual labor required for the daily cleaning operation.

As earlier noted, it is frequently desirable, if not absolutely necessary, to provide a substantially recycling cooking oven with a vent to allow for a planned escape of hot air from the oven. The vent allows the volume of gas to change so as to maintain a constant air pressure within the oven and thereby minimize leakage of the hot air out of the oven into the ambient atmosphere or a blast of hot air being directed at the user when the user opens the oven door. The vent also acts to control moisture build up during the cooking process which can negatively impact food texture if it becomes excessive. The vent further enables an oven with a self-cleaning feature to expel from the oven interior various oxidizable components removed from the walls of the cooking chamber during self-cleaning.

As also earlier noted, the use of a vent may present problems with the oven complying with various ecological requirements, (e.g., Southern California Air Quality District Standards) such as the cleanliness of the auxiliary vent stream emitted into the ambient atmosphere, via the vent from the oven interior. Nonetheless, compliance with such ecological requirements must be achieved in an economical manner.

Thus, in the illustrated preferred embodiment, in addition to the main or recycling catalytic converter 50, the oven 10 includes a vent, generally designated 60, which provides gaseous communication between the ambient atmosphere and the main catalytic converter 50. While in the illustrated embodiment the vent 60 extends upwardly from the plenum 20 through the oven housing 12, depending on the limiting dimensional parameters for the oven housing 12 the vent 60 may extend out the rear (as shown), one or both sides, or even the bottom of the oven. The vent means 60 diverts an auxiliary vent stream of hot air from the main catalytic converter 50. It will be appreciated by those familiar with the art that the vent 60 may communicate directly with the main catalytic converter 50 or, as illustrated, indirectly via the thermal plenum 20. Preferably the vent 60 communicates with the main catalytic converter 50 via the thermal plenum 20 so that the gases in the thermal plenum 20 may receive at least partial benefit of the heat produced by the exothermic catalytic oxidation of the oxidizable components in the auxiliary vent stream.

The proportion of the hot air stream which enters the vent 60 may be fixed by the volumetric flow capacity of the vent 60. Alternatively, louvers, doors or the like (not shown) may be provided in the vent means 60 in order to enable adjustment of the volumetric flow therethrough. For example, the potential volumetric flow through the vent 60 may be made minimal during normal operation of the oven, but made significantly higher during a self-cleaning cycle.

In order to reduce the amount of airborne grease which is discharged into the ambient air about the oven via vent 60, and thereby minimize the noticeable level of unpleasant airborne grease odor and the airborne grease which settles on substrates adjacent to the oven, in the illustrated preferred embodiment of the present invention an auxiliary catalytic converter, generally designated 62, is disposed in the vent 60, downstream of the main or recycling catalytic converter 50, and passes through the rear of oven housing 12. The auxiliary catalytic converter 62 flamelessly oxidizes oxidizable components of the hot air of the auxiliary vent stream passing through the vent 60, thereby to remove oxidizable components from the hot air of the auxiliary vent stream and so release a relatively clean auxiliary vent stream of hot air from vent 60 into the ambient atmosphere. It will be appreciated that only hot air which has already passed through the main or recycling catalytic converter 50 is presented to the auxiliary catalytic converter 62 within the vent 60. Accordingly, this hot air (namely, the vent stream) has already had its oxidizable component level reduced—as has the remainder of the hot air stream, namely, the recycling stream—to some degree (e.g., about 20%) by the main catalytic converter 50. Thus a portion of the function which would otherwise have to be performed by the auxiliary catalytic converter 62 has already been performed by the main catalytic converter 50, and the auxiliary catalytic converter 62 need only further lower the oxidizable component level to an acceptable discharge level.

The auxiliary catalytic converter 62 preferably has an inlet temperature of at least 325° F. with catalytic activity increasing with higher operating conditions. The catalytic material of the auxiliary catalytic converter 62 may be the same as or different from that in the main catalytic converter 50. Similarly, the configuration and dimensions of the auxiliary catalytic converter 62 may be the same as or different from the configuration and dimensions of the main catalytic converter 50. The configuration and dimensions of the two catalytic converters relative to one another will depend at least in part upon the relative space available for the main catalytic converter within housing 12 and the auxiliary catalytic converter 62 within the vent 60.

The acceptable discharge level of oxidizable components in the hot air stream emitted from the vent 60 into ambient atmosphere will depend upon various factors, including indoor air quality standards (e.g., UL197 for commercial applications), and consumer demands.

While the main catalytic converter 50 alone will generally effect a total hydrocarbon conversion of about 44% and a total VOC conversion of about 50% (say, from an inlet level of 207 PPM to the main catalytic converter to an outlet level of 114 PPM from the main catalytic converter), the auxiliary catalytic converter 62 will generally effect a much higher total hydrocarbon conversion of about 80–84% and a much higher total VOC conversion of about 88–96% (say, from an inlet level of 102 PPM to the auxiliary catalytic converter to an outlet level of 16 PPM from the auxiliary catalytic converter).

The total hydrocarbon conversion percentage is based on calculations involving the following chemical species in the stream of hot air: acetaldehyde, acrolein, propenaldehyde, cortinaldehyde, acetone, valeraldehyde, butyraldehyde, acetic acid and methane). By way of contrast, the total VOC (Volatile Organic Compounds) conversion percentage does not include methane (an odorless gas) from the total hydrocarbon conversion percentage calculation since methane cannot be converted (oxidized) using the preferred catalyst of the present invention. Of the total hydrocarbons emitted from the vent catalyst, an average of 0.9 or less PPM VOC irritants exit the vent during operation.

It will be appreciated that these conversion percentages vary with the catalyst type and size, the inlet hydrocarbon level and type, and the like. Nonetheless, it is clear that the auxiliary catalytic converter 62 enables the oxidizable components level to be strongly reduced as necessary (over the reduction provided by the main catalytic converter 50 itself) so as to meet both user requirements and applicable governmental requirements. But because the auxiliary catalytic converter 62 is acting only on a relatively small portion of the total stream of hot air (i.e., a portion excluding the recycling stream) and because the oxidizable component level of that small portion of the stream has already been reduced by passage through the main catalytic converter 50, the auxiliary catalytic converter 62 may employ less catalytically active material or a smaller amount of catalytic material than would otherwise be the case. Preferably the catalytic material of the main catalytic converter 50 is a Type E catalyst while the catalytic material of the auxiliary catalytic converter 62 is a Type Q catalyst, although the particulars of these catalysts are not made public by their manufacturer (Englehard Corporation), except that they both contain a metal foil substrate.

Figure 4:
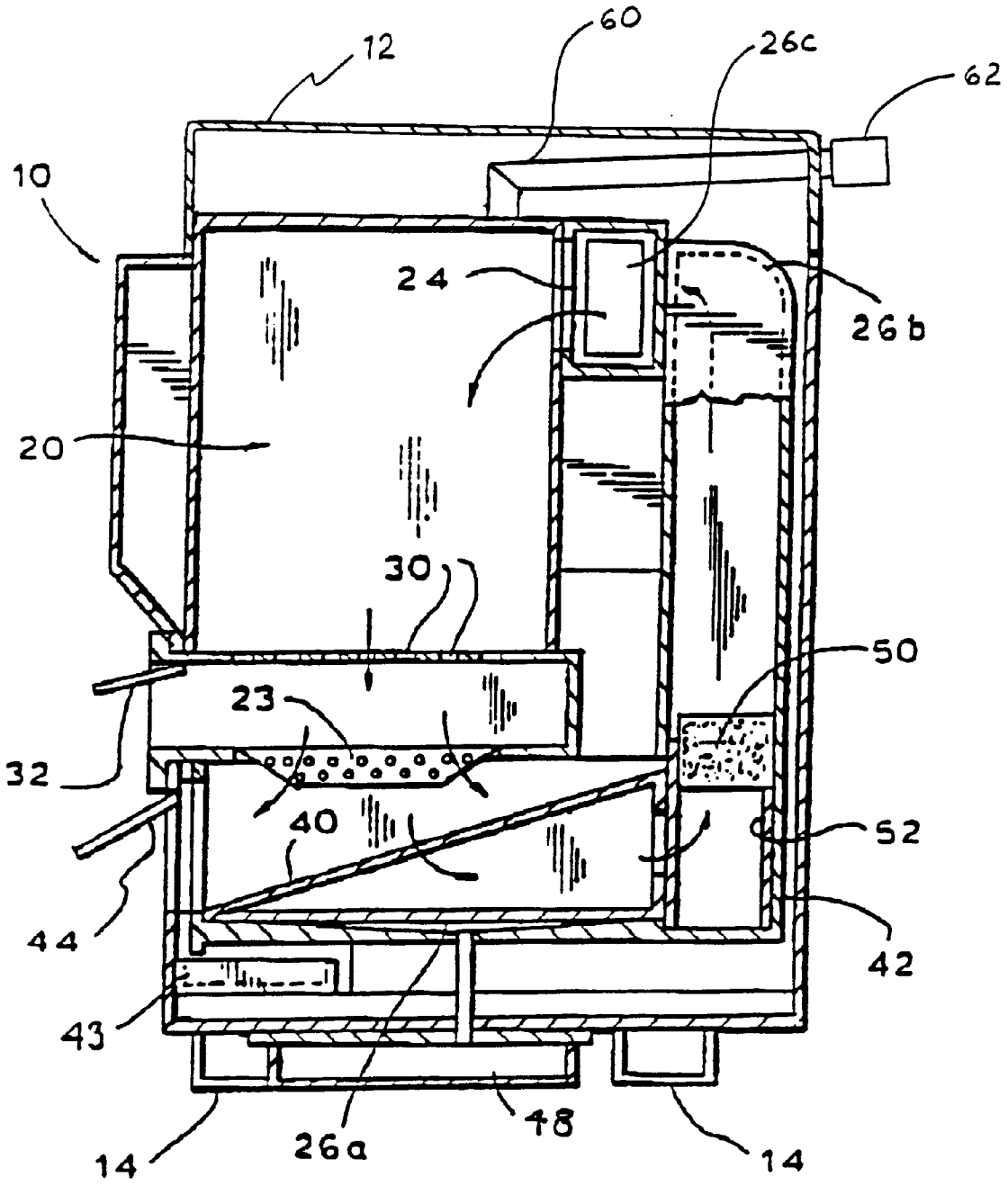
FIG. 4 is a sectional view of the oven taken along the line 4—4 of FIG. 1.

Thus the catalytic material of the main catalytic converter 50 typically has 150 cells per square inch, while the catalytic material of the auxiliary catalytic converter 62 has only about 115 cells per square inch. The catalytic material of the main catalytic converter 50 is preferably cylindrical, with volume of about 0.01 $ft^3$ with space velocities greater than 400,000 $hr^{-1}$ while the catalytic material of the auxiliary catalytic converter 62 is preferably cylindrical, with a volume less than 0.01 $ft^3$ with space velocities less than 70,000 $hr^{-1}$. As a portion of the vent 60 sits more or less in the void between the outside of the cooking chamber 22 and the inside of the oven housing 12, its configuration and dimensions may easily be varied to meet the needs of convenience, cost and ease of manufacturability. The auxiliary catalytic converter 62 may be disposed in the same void or be disposed outside of housing 12 adjacent the projecting free end of vent 60, as best shown in FIG. 4.

Judicious placement of the auxiliary catalytic converter 62 relative to the plenum 20 may result in some heating benefit being received by the hot air in plenum 20 from the exothermic heat of the reaction proceeding in the auxiliary catalytic converter 60 within the vent 60; otherwise, the entire exothermic heat of the reaction produced in the vent 60 is lost to the system.

To summarize, the present invention provides a recycling cooking affording a substantially closed but vented environment. An auxiliary or vent catalytic converter is disposed in the vent, downstream of the main or recycling catalytic converter, for further reducing the level of oxidizable components in the vent stream. The auxiliary catalytic converter (due to changes in dimensions and/or catalytic material) is more economical than the main catalytic converter. The oven is simple and economical to manufacture, use and maintain.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. A recycling cooking oven for cooking food at least in part by hot air flow and providing a substantially closed but vented environment, comprising:

A. a cooking chamber for receiving a stream of hot air from a thermal plenum via a plurality of openings in said cooking chamber, said cooking chamber cooking food therein at least partially with hot air from the plurality of openings and the cooking of such foods adding oxidizable components to the hot air;

B. means forming a thermal plenum located upstream of said cooking chamber and including heating means for supplying hot air into said cooking chamber via said plurality of openings;

C. means for causing the stream of hot air to circulate in substantially a continuous travel path including said thermal plenum, said plurality of openings and said cooking chamber;

D. a main catalytic converter disposed in said continuous travel path of the stream of hot air for flamelessly oxidizing oxidizable components in the hot air of the stream leaving said cooking chamber, thereby both to remove them from the hot air of the stream and to release at least some additional heat energy into the hot air of the stream;

E. vent means communicating with ambient atmosphere and said main catalytic converter for diverting an auxiliary vent stream of hot air from said main catalytic converter into said vent means; and F. an auxiliary catalytic converter disposed in said vent means, downstream of said main catalytic converter, for flamelessly oxidizing oxidizable components in the hot air of the auxiliary vent stream passing through said vent means, thereby to further remove oxidizable components from the hot air of the auxiliary vent stream and so release a relatively clean auxiliary vent stream of hot air from said vent means into the ambient atmosphere.

2. The oven of claim 1 wherein said thermal plenum maintains said reservoir of hot air at least 325° F.

3. The oven of claim 1 wherein said main catalytic converter has an inlet temperature of at least 325° F.

4. The oven of claim 1 wherein said oxidizable components include grease, fats, oils and like hydrocarbons produced by cooking food in said cooking chamber.

5. The oven of claim 1 wherein said oxidizable components are oxidizable essentially to carbon dioxide and water.

6. The oven of claim 1 wherein said vent means communicates substantially directly with said main catalytic converter.

7. The oven of claim 1 wherein said vent means communicates with said main catalytic converter only via said thermal plenum.

8. The oven of claim 1 wherein said auxiliary catalytic converter has an inlet temperature of at least 325° F.

9. The oven of claim 1 wherein said plurality of openings is in a top of said cooking chamber, and said heating means supplies hot air downwardly into said cooking chamber via said plurality of openings.

10. The oven of claim 1 wherein a single pass of an auxiliary vent stream of hot air through said auxiliary catalytic converter lowers the level of the oxidizable components in the hot air more than would a single pass of the stream of hot air through said main catalytic converter.

11. A recycling cooking oven for cooking food at least in part by hot air flow and providing a substantially closed but vented environment, comprising:

A. a cooking chamber for receiving a stream of hot air from a thermal plenum via a plurality of openings in a top of said cooking chamber, said cooking chamber cooking food therein at least partially with hot air from the plurality of openings and the cooking of such foods adding oxidizable components including hydrocarbons produced by cooking foods in said cooking chamber, to the hot air;

B. means forming a thermal plenum located upstream of said cooking chamber and including a heating means for supplying hot air downwardly into said cooking chamber via said plurality of openings, said thermal plenum maintaining a reservoir of hot air therein;

C. means for causing the stream of hot air to circulate in substantially a continuous travel path including said thermal plenum, said plurality of openings and said cooking chamber;

D. a main catalytic converter disposed in said continuous travel path of the stream of hot air, downstream of said cooking chamber and upstream of said thermal plenum, for flamelessly oxidizing oxidizable components in the hot air of the stream leaving said cooking chamber, thereby both to remove them from the hot air of the stream and to release at least some additional heat energy into the hot air of the stream;

E. vent means communicating with ambient atmosphere and said main catalytic converter for diverting an auxiliary vent stream of hot air from said main catalytic converter into said vent means; and F. an auxiliary catalytic converter disposed in said vent means, downstream of said main catalytic converter, for flamelessly oxidizing oxidizable components in the hot air of the auxiliary vent stream passing through said vent means, thereby to further remove oxidizable components from the hot air of the auxiliary vent stream and so release a relatively clean auxiliary vent stream of hot air from said vent means into the ambient atmosphere.

12. The oven of claim 11 wherein said vent means communicates substantially directly with said main catalytic converter.

13. The oven of claim 11 wherein said vent means communicates with said main catalytic converter only via said thermal plenum.

14. The oven of claim 11 wherein said auxiliary catalytic converter has an inlet temperature of at least 325° F.

* * * * *